US005476741A

United States Patent [19]

Nishikiori et al.

[11] Patent Number: 5,476,741

[45] Date of Patent: Dec. 19, 1995

[54] TONER FOR HEAT FIXING

[75] Inventors: Takuya Nishikiori, Odawara; Yoshio Kojima, Kawasaki; Takashi Shintaku, Machida; Mikio Uno; Yoshihiro Kigami, both of Odawara, all of Japan

[73] Assignee: Mitsubishi Chemical Corporation, Tokyo, Japan

[21] Appl. No.: 288,241

[22] Filed: Aug. 9, 1994

[30] Foreign Application Priority Data

Aug. 9, 1993 [JP] Japan ..... 5-197430
Aug. 9, 1993 [JP] Japan ..... 5-197431

[51] Int. Cl.[6] ..... G03G 9/087

[52] U.S. Cl. ..... 430/109; 430/99

[58] Field of Search ..... 430/106, 106.6, 430/109, 110, 904, 99

[56] References Cited

U.S. PATENT DOCUMENTS 4,971,879 11/1990 Kimura et al. ..... 430/106.6
5,126,224 6/1992 Hyosu et al. ..... 430/106.6
5,230,978 7/1993 Kawasaki et al. ..... 430/109
5,364,721 11/1994 Asada et al. ..... 430/109

FOREIGN PATENT DOCUMENTS 64-70765 3/1989 Japan .
64-88556 4/1989 Japan .
5-80581 4/1993 Japan .
5-100468 4/1993 Japan .
5-127424 5/1993 Japan .
5-142860 6/1993 Japan .

*Primary Examiner*—John Goodrow
*Attorney, Agent, or Firm*—Oblon, Spivak, McClelland, Maier & Neustadt

[57] ABSTRACT

A toner for heat fixing comprising a styrene type resin and a colorant and satisfying the following formula:

$A \leqq 900$ ppm and $B \geqq 80\%$, or $A \leqq 650$ ppm and $B \geqq 70\%$ wherein A is a quantity of volatile components of the toner to be measured by a head space method, and B is a percentage of raw material monomers and solvents to be used in production of a binder resin in the quantity of the volatile components.

13 Claims, No Drawings

TONER FOR HEAT FIXING

BACKGROUND OF THE INVENTION

The present invention relates to a toner for heat fixing for use in electrophotographic methods arid electrostatic recording methods such as in electrophotographic copying machines and printers.

A developer to be used in an electrophotographic copying machine is, in a developing step, deposited once on an image carrier such as a photoreceptor on which, for example, an electrostatic image is formed, then, in a transfer step, transferred from the photoreceptor to a transfer paper, and fixed onto a copying paper in a fixing step. In this case, a two-component developer comprising a carrier and a toner and a one-component developer (magnetic toner or non-magnetic toner) requiring no carrier are known as the developer for developing the electrostatic image to be formed on a latent image maintaining surface thereof.

A toner contained in the developer comprises a binder resin for the non-magnetic toner, or a binder resin and magnetic particles for the magnetic toner as a main component or main components and dispersedly contains a colorant, a charge control agent and a mold releasing agent.

In most cases, a styrene-acryl type resin or a polyester type resins used as the binder resin and a raw material monomer, a polymerization starting agent and a synthetic solvent used in a step of synthesis of these resins. In some cases, amine compounds may be contained in the charge control agent as impurities. In cases that a charge control agent of quaternary ammonium salt group or the like is used and a kneading temperature for the binder resin in a kneading and dispersing step is excessively high, amine compounds may be produced by chemical reaction with other components.

As a method to be currently used for fixing the toner, heat fixing methods such as, for example, a heat roll fixing method, an oven fixing method and a flash fixing method by which the binder resin contained in the toner is melt and fixed is generally used to obtain a sufficient fixing strength even though a pressure fixing method and the like have been attempted. The heating temperature, for example, in the case of heat roll fixing method is approximately 100°–220° C. In this case, there has been a problem that the above-described raw material monomer and impurities remaining in the toner are vaporized with a particular offensive odor. Since lately copying machines and printers have come to be often used nearby working people in offices along with down-sizing of these equipment, various problems with respect to such odor have been discussed with keen interests. On the other hand, generation of ozone due to corona discharging which has been considered as a cause of another offensive odor produced from electrophotographic machines has been substantially eliminated by technological innovations owing to development of a corona discharger or the like in which charging of the rollers and the brush or generation of ozone are minimized. Therefore, a problem of an odor which is produced from volatile components contained in the toner during heat fixing has been, in turn, considered as a relatively serious issue.

If these impurities are chemically unstable at normal temperature, volatile substances may be further decomposed or produced from the impurities. These volatile substances contained in the toner may be a cause of an offensive odor during storage of the toner. For example, if benzoyl peroxide is used as a polymerization starting agent, benzoic acid and biphenyl which will be the sources of such offensive odor are produced from benzoyl peroxide and remain in the binder resin.

In view of the above, as disclosed, for example, in Japanese Patent Application Laid-open (KOKAI) No. 64-70765, an idea for reducing the monomers remaining in the binder resin has been proposed and moreover there has been a teaching that it should be avoided to cause the polymerization starting agent and a chain transfer agent to remain in the toner. Japanese Patent Application Laid-open (KOKAI) No. 64-88556 has disclosed a method for synthesizing the binder resin without using an emulsifier and a disperant with an object to ensure a safety with respect to an amount of charge and reduce an effect of environmental humidity and further a method for reducing the raw material monomers, the synthetic solvent and the polymerization starting agent to be contained in the binder resin by means of vacuum flushing, in addition to the problem of the odor of toner. These methods can be considered effective as the methods to reduce volatile components in the toner.

In view of the toner as a finished product, however, it is insufficient unless not only the binder resin but also volatile components derived from a colorant and the charge control agent should be noted, and all volatile components of the binder resin including those individual volatile components such as the polymerization starting agent and residual monomers should be checked. Through the toner manufacturing steps from kneading of raw materials to the final product, attentions should be paid to volatile components produced due to chemical decomposition and reactions of raw materials. Hitherto, there have been rarely observed studies as to reduction of volatile components or odor producing substances of the final toner product as a whole.

As a result of examinations to solve the above-described problems, the present inventors have found that the problem of the odor could be solved if the quantities of volatile components obtained were controlled to be less than specific values in the measurement of the quantities of all volatile components of the toner as a whole carried out by a head space method with an object to take into account the volatile components derived from both raw materials of the toner and the manufacturing steps, and have reached the present invention and the composition of components thereof.

SUMMARY OF THE INVENTION

In an aspect of the present invention, there is provided a toner for heat fixing comprising a styrene type resin and a colorant and satisfying the following formula:

$$A \leqq 900 \text{ ppm and } B \geqq 80\%, \text{ or}$$

$$A \leqq 650 \text{ ppm and } B \geqq 70\%$$

wherein A is a quantity of volatile components of the toner to be measured by a head space method, and B is a percentage of raw material monomers and solvents to be used in production of a binder resin in the quantity of the volatile components.

DETAILED DESCRIPTION OF THE INVENTION

Various types of styrene type resins suited for the toner are available for the present invention. These resins include styrene type resins such as, for example, polystyrene, chloropolystyrene, poly-α-methyl styrene, styrene-chlorostyrene copolymer, styrene-propylene copolymer, styrene-butadiene copolymer, styrene-chloride copolymer, styrene-vinyl acetate copolymer, styrene-ester acrylate copolymers (styrene-methyl acrylate copolymer, styrene-ethyl acrylate copolymer, styrene-butyl acrylate copolymer, styrene-octyl acrylate copolymer, and styrene-phenyl acrylate copolymer), styrene-ester methacrylate copolymers (styrene-methyl methacrylate copolymer, styrene-ethyl methacrylate copolymer, styrene-butyl methacrylate copolymer, and styrene-phenyl methacrylate copolymer), and styrene-α-methyl chloroacrylate copolymer, and styrene-acrylonitrile-ester acrylate copolymer (monopolymers and/or copolymers containing styrene or substituted styrene). Particularly preferable styrene type resins for use in the present invention include polystyrene, styrene-ester acrylate copolymer, styrene-ester methacrylate copolymer, and styrene-butadiene copolymer. The above-described resins can be used independently and as a mixture of two or more types of resins.

Preferable styrene type resins to be used in the present invention are such that, when dissoluble components of a resin obtained after insoluble components have been removed from the resin dissolved in tetrahydrofuran are measured in the GPC (Gel permeation Chromatography), one or more molecular weight peak of low molecular weight substances (Lp) is included in a range of 3,000–80,000 and more preferably in a range of 4,000–50,000, and one or more molecular weight peak of high molecular weight substances (Hp) is included in a range of 80,000–1,500,000 and more preferably in a range of 100,000–1,200,000. A ratio of the low molecular weight substance to the high molecular substance is preferably 80–40 weight parts to 20–60 weight parts.

Though fixing of the toner is satisfactory if Lp is lower than 3,000, a spent toner and fine pulverization of toner are liable to be caused in a developing machine and therefore the image quality and the life of the developer deteriorate. If Lp is higher than 80,000, fixing of the toner in a low temperature area is unsatisfactory and the cold offset temperature also shows an unpreferable value though a spent toner and fine pulverization of toner are not liable to be caused. The Hp lower than 80,000 is unpreferable because, though fixing of the toner is satisfactory, a hot offset is liable to be caused and the range of applicable fixing temperature is decreased. The Hp exceeding 1,500,000 is unpreferable because fixing of the toner in the range of low temperature is unsatisfactory and the lower limit of the fixing temperature rises though the anti-offset property is satisfactory.

If the ratio of the low molecular weight substance exceeds 80 weight parts, the anti-offset property deteriorates, though fixing of the toner is satisfactory, the range of applicable temperature is decreased and the toner obtained tends to be a spent toner to the carrier and to cause fine pulverization of toner. If the toner is used for a long period of time, scattering of the toner and blotting on a white background by the toner tend to be more remarkable. If the ratio of the low molecular weight substance is less than 40 weight parts, the durability and the anti-offset property of the developer are satisfactory but the fixing in the range of low temperature tends to deteriorate and the lower limit of fixing temperature tends to rise.

The low molecular weight substance is preferably a styrene type copolymer which contains 50–100 weight parts of styrene and 0–50 weight parts of ester acrylate and/or ester methacrylate in terms of the monomer unit. The high molecular weight substance is preferably a styrene type copolymer which contains 40– 90 weight parts of styrene and 10–60 weight parts of ester acrylate and/or ester methacrylate in terms of the monomer unit.

A glass transition temperature of a styrene type resin is preferable 50° C. or over. A glass transition temperature which is lower than 50° C. is not preferable because the toner is liable to be aggregated or anchored when the toner is left at a high temperature exceeding 40° C. for a long period of time.

A flow softening temperature of a styrene type resin can be appropriately selected in view of the fixing performance of the toner, durability of the developer, and others. In case of fixing by the heat roller fixing method at a temperature of 120°–220° C., the softening temperature is preferably, for example, 80°– 160° C. and more preferably 90°–150° C.

In addition to the above-described styrene type resins, other kinds of resins can be simultaneously used in combination at a preferable percentage of 30 weight % or less for the total quantity of all resins. These other kinds of resins include rosin denatured maleic resin, phenol resin, silicone resin, ketone resin, epoxy resin, polyester resin, xylene resin and polyvinyl butyral resin, which can be used independently or as a mixture of two or more kinds of resins.

Resin manufacturing methods which are generally used include a suspension polymerization method by which a polymerization reaction is conducted in a medium such as water in which no dissolution takes place, a solution polymerization method by which the polymerization reaction is carried out in a solvent of xylene or toluene, a bulk polymerization method by which the polymerization reaction is carried out without using a solvent or a medium, and a combination of these methods. As a reaction method, a method using a polymerization starting agent and a thermal polymerization method for which the polymerization starting agent is not used or an extremely small quantity of the polymerization starting method is added are used. As the polymerization starting agent for manufacturing styrene type resins, benzoyl peroxide, 2,2'-azobis isobutylonitrile are generally used. A polymerization accelerator and a polymerization inhibitor are generally added for adjusting the molecular weight and the molecular weight distribution. N,N-dimethyl aniline, tetrahydroquinoline, ad triethyl amine are known as the polymerization accelerator. Aromatic nitro compounds and mercapto compounds are representative polymerization inhibitors.

Though resins unavoidably contain raw material monomers, synthetic solvents or auxiliary agents as described above, it is preferable to use resins which least contain those substances as described above in the present invention. Therefore, it is preferable to select a resin manufacturing step in which synthetic solvents and auxiliary agents are least used or remove volatile impurities in the latter steps for manufacturing resins. The methods for removing such impurities include a method for expelling out volatile impurities through a pressure reducing step, a heat treating step or simultaneous application of these steps and a method for removing volatile impurities with a solvent in which resin components will not be dissolved.

Pigments and dyes which are known can be used as colorants for the present invention. For example, titanium oxide, zinc white, carbon black, alumina white, calcium carbonate, iron blue, phthalocyanine blue, phthalocyanine green, Hansa yellow G, rhodamine type dyestuff, chrome yellow, quinacridon, benzidine yellow, rose bengal, triallyl methane type dyestuff, anthraquinone dyestuff, and monoazo and diazo type dyestuff can be used independently or as a mixture for toner colorants. Preferable colorants for use in the present invention should not or should least contain volatile impurities carried forward from the synthetic step. A content of colorant is satisfactory if sufficient for coloring the toner capable of providing a visible image through development; for example, the content of the colorant is preferably 1–20 weight parts for 100 weight parts of a binder resin and more preferably 3–15 weight parts.

Generally, black and brown magnetic particles can be used as the colorants for magnetic toners. Magnetic particles to be used in the present invention are highly magnetic substances which provide a ferri-magnetism or a ferromagnetism at an environmental operating temperature (0° to 60° C.) for copying machines; for example, magnetite ($Fe_3O_4$); maghemite ($\gamma$-$Fe_2O_3$); an intermediate between magnetite and maghemite; spinel ferrite such as ferrite ($M_xFe_{3-x}O_4$, where M denotes Mn, Fe, Co, Ni, Cu, Mg, Zn, Cd or a mixed crystal group of these elements); hexagonal ferrite such as $BaO.Fe_2O_3$ and $SrO.Fe_2O_3$, garnet type oxides such a $Y_3Fe_5O_{12}$ and $Sm_3Fe_5O_{12}$; rutile type oxides, metals such as Fe, Mn, Ni, Co and Cr, and other highly magnetic alloys include those which provide the ferromagnetism and the ferri-magnetism at approximately 0° to 60° C. Fine particles of magnetite, maghemite or an intermediate between magnetite and maghemite with an average particle size of preferably 3 μm or under and more preferably approximately 0.05 to 1 μm are preferable in the points of performance and costs. The above-described magnetic particles can be not only used independently and in combination of two or more kinds. An additive quantity of magnetic particles greatly differs with a developing system, the particle size of toner and other factors and generally magnetic particles corresponding to 10 to 80 weight %, preferably 25 to 60% of the total quantity of toner is dispersedly contained in the toner.

In the present invention, the toner containing polyolefin wax such as low molecular weight polypropylene and low molecular weight polyethylene provides more distinguished effects with respect to the fixing property. Polypropylene can be preferably used as polyolefin wax for use in the present invention. The number-average molecular weight (Mn) of polyolefin wax is preferably 3,000 to 10,000 and more preferably 4,000 to 9,000 as measured by a vapor pressure osmotic method. A number-average molecular weight less than 3,000 is not preferable because the image quality is deteriorated by streak type image unevenness of an all-blackened portion of a toner image and partial missing of an image and a high image density cannot be stably obtained though an offset preventing effect in fixing is obtained. A number-average molecular weight higher than 10,000 is not preferable because a sufficient offset preventing effect in fixing cannot be obtained though the image quality and the image stability are excellent. A content of polyolefin wax in the toner differs with binder resin components, colorants and a fixing mechanism to be used. In the heat roller fixing method, the content of polyolefin wax is preferably in general 0.2 to 10 weight parts and more preferably 0.5 to 7 weight parts for 100 weight parts of binder resin. The content of polyolefin wax less than 0.2 weight parts reduces the offset preventing effect in fixing and the content of polyolefin wax exceeding 10 weight parts adversely affects a fluidity and a charging property of the toner and incurs deterioration of the quality and stability of images, and therefore these values of contents are not preferable. In addition to the above-described polyolefin wax, polyolefin wax in a different range of number-average molecular weight, paraffin wax, higher fatty acid, fatty acid amide and metal soap can be added in small quantities. If volatile components in the wax are increased, it is not preferable in that the stability of image density in successive copying deteriorates and, particularly, the toner density in a two-component developer greatly changes, thereby deteriorating the stability of charge of the toner, increasing a range of superposition, further causing scattering of toner in copying machines. If volatile components are 0.5% or under, the stability of the charge of the toner and the toner density in the developer are satisfactory and image stability and toner scattering are also satisfactory. The quantities of volatile components in the wax are obtained as reduced values of weights after drying at 115° C. for four hours. A melting point of the wax is preferably 100° to 180° C. and more preferably 120° to 160° C. as measured from the peak position temperature of a heat absorbing pattern in thermal analyses (differential thermal analyzer, differential thermal scanning calorimeter, etc.). In case of a wax having a high melting point of 180° C. or over, it is not preferable in that wax cannot be fully melted even when heating the toner in production of the toner through a melt extruder, solubility and dispersion into resin are deteriorated, and the minimum fixing temperature of the toner lowers. A wax having a low melting point of 100° C. is not preferable in that the toner hardly shares a kneading effect and dispersion of colorants and other additives deteriorates.

In addition, for the toner according to the, present invention, known positive charging type and negative charging type charge control agents can be used independently or in combination and the amounts for use can be selected in accordance with a desired amount of charge, and the additive quantities of charge control agents are preferably 0.05 to 10 weight parts for 100 weight parts of a binder resin. Positive charging type charge control agents include a nigrosine type dye, a quaternary ammonium salt, a triaminotriphenylmethane type compound, an imidazole type compound, and a polyamine resin. Negative charging type charge control agents include azo dyes containing such metals as Cr, Co, Al, and Fe, a salicylic acid metal compound, and an alkyl salicylic acid metal compound. As the colorants, it is preferable to select and use a charge control agent which does not contain volatile impurities. Particularly, for in a case of a nitrogen type charge control agent, the presence of amine type substances should be carefully checked. In particular, it should be checked whether or not quaternary ammonium salts contain amine substances produced from decomposition in the toner producing step.

Moreover various kinds of auxiliary agents such as plasticizers and parting agents can be added to the toner to adjust thermal characteristics and physical characteristics. An appropriate additive quantity is 0.1 to 10 weight parts.

In addition, additive agents such as a low molecular weight olefin polymer, fine particle silica, alumina and titania to improve the fixing property and fluidity, and inorganic fine particles such as magnetite, ferrite, cerium oxide, strontium titanate and electrically conductive titania and organic fine particle such as styrene resin and acryl resin for adjustment and lubrication, can be contained as internal additive agents or external additive agents in the toner of the developer according to the present invention. The quantities of these additive agents to be used can be appropriately determined to be, for example, preferably about 0.05 to 10 weight parts for 100 weight parts of the binder resin.

Various conventional toner manufacturing methods can apply to production of tone particles of the developer according to the present invention. As a common example, for instance, a resin, a colorant, a wax and a charge control agent are uniformly dispersed and mixed in a mixer, subsequently a mixture is melted and kneaded by a closed kneader or a one-shaft or two-shaft extruder, and a kneaded mixture can be coarsely pulverized by a crusher or a hammer mill, finely pulverized by a jet mill and a high speed rotor rotation mill, and classified by a blow classifier (for ,example, an inertial classification elbow jet, centrifugal classification microplex, DS separator, etc.). An appropriate average particle size of the toner is 3 to 20 μm. In the above melting and kneading step, it is preferable to expel volatile impurities in a range where the charging performance and the fixing performance of the final toner may not be impaired. In the examination by the present inventors, it was ascertained that a residual monomer (styrene) and a synthetic solvent (xylene) derived from a binder resin would be reduced by 20 to 40% by the melting and kneading step though there is a certain variation. It is preferable to additionally provide a volatile impurities removing step by reducing the pressure and heating the toner on the halfway or the end of the toner producing step to further reduce volatile impurities.

For further external addition, a classified toner and external additive agents can be stirred and mixed by a high speed stirring machine (such as a Henschel mixer, super mixer, etc.). The toner according to the present invention also can be used as a one-component type developer (a magnetic one-component type toner which contains a magnetic substance such as magnetite or a non-magnetic one-component type toner which does not contain a magnetic substance).

The head space method is used to measure final volatile impurities contained in the toner which has been obtained as described above. The head space method is such that the toner is sealed in a closed container and heated to a temperature as in heat fixing of a copying machine, a gas in the container is quickly poured into a gas chromatograph under the condition that the container is filled with a volatile component, and an amount of volatile component is measured. As another method for measuring the amounts of impurities derived from the binder resin, a method has been well known by which the binder resin or the toner is melted with a solvent and poured into the gas chromatograph. However, this method is unsuitable to measurement of a total quantity of volatile impurities since a peak of an impurity may be hidden by a peak of the solvent. In this connection, the head space method to be used in the present invention enables to observe all peaks of volatile components related to an offensive odor.

Measurement by the head space method is described in detail below.

MEASURING METHOD

1. Sampling

A sample of 1 g is sampled in a head space vial. A quantity of sample is measured in an increment of 0.01 g (necessary to calculate an area per unit weight). The vial is sealed with a special clean bar and a septum.

2. Heating of Test Sample

A test sample is set in an upright position in a thermostat of 130° C. and heated for 30 minutes.

3. Setting of Conditions for Separation by Gas Chromatograph

A column of 3 mm in inside diameter and 3 m in length which is filled with a carrier (chromosorf w:AWCS) which is coated with an silicone oil SE-30 so as to be 15% in the weight ratio is used as a separation column. This separation column is mounted on the gas chromatograph and helium is let to flow as the carrier at a rate of 50 ml/min. The temperature of the separation column is set at 60° C. and measurement is conducted while raising the temperature up to 200° C. at the rate of 10° C./min. The test sample is held as is for 5 minutes after the temperature has reached 200° C.

4. Introduction of Test Sample

A sample vial is taken out from the thermostat and 1 ml of the test sample is immediately injected using a gas tight syringe.

5. Introduction of Reference Test Sample

2 μl of a styrene hexane solution adjusted to 1000 ppm is injected as a reference test sample.

CALCULATION

If 2 μl of a 1000 ppm styrene solution is injected, it means that 2 μg of styrene is injected and it is equivalent to 0.43 μl in terms of a capacity at normal temperature and pressure. Accordingly, a quantity of volatile component can be calculated by the following formula.

$$\text{Volatile component (ppm)} = \frac{0.43 \times \text{Area of test sample}}{\text{Reference area of styrene}} \times 1000$$

EQUIPMENT

Gas chromatograph—GC—9APF manufactured by Shimazu

Heating furnace—GC—4BPTF manufactured by Shimazu

Sample bottle—Vial manufactured by Shimazu (Capacity: 20 ml)

Septum—Septum for the above vial (Heat resistance: 150° C.)

Gas-tight syringe—Gas-tight syringe manufactured by DYNATECH PRECISION Corp. (Capacity 2 ml)

If the quantity of volatile components is 900 ppm or under and 80% or over of the quantity of volatile components is shared by the raw material monomer and the solvent component which are derived from the binder resin, or the quantity of volatile components is 650 ppm or under and 70% or over of the quantity of volatile components is shared by the raw material monomer and the solvent component which are derived from the binder resin, a toner with a particularly low odor can be obtained. An odor derived from the toner is rarely felt from the exhaust opening of the copying machine even when the toner passes through the heat fixing step of the copying machine.

In a case that a toner according to the present invention is used as a two-component type developer, it can be mixed with a magnetic carrier, and iron particles, ferrite particles and magnetic resin carrier which have been known can be used. The toner applied surface can be used which is coated with a single layer or multiple layers by using independently or in combination those resins such as a known silicone type resin, an acryl type resin, a fluorine type resin, a styrene type resin, an epoxy type resin, a polyester type resin, a polyamide type resin and a mixture of these resins. Ferrite particles given by a general formula $(MO)_m(Fe_2O_3)_n$ are preferable as a ferrite core, and one or two kinds of components such as CuO, ZnO, NiO, FeO, MnO, MgO and BaO can be selected and used as a (MO) component. Though the particle sizes of these carriers are not limited, the carriers preferably have an average particle size of 10 to 200 μm. A mixing ratio of the carriers and toner is preferably 1 weight part of the toner to 5 to 100 weight parts of carriers.

Methods of testing binder resins to be used in this specification are described below.

Molecular Weight Measuring Method

A molecular weight at the peak of the molecular weight distribution can be measured by the gel permeation chromatography (GPC) under the following conditions.

Specifically, a solvent (tetrahydrofuran)is flown at a flow rate of 0.5 ml/m or 1 ml/m and 40° C. and a tetrahydrofuran sample solution of 0.1 weight % concentration is measured by injecting 100 μl as a sample weight. For measuring the molecular weight of the sample, such measuring conditions are selected as the molecular weight distribution of the sample is included in a range where a logarithm and a count number of a molecular weight of a working curve prepared with respect to several kinds of monodispersed polystyrene standard samples. For this measurement, the reliability of the measurement can be confirmed from a fact that Mw/Mn of NBS706 polystyrene standard samples ($Mw=28.8\times10^4$, $Mn=13.7\times10^4$, Mw/Mn=2.11) under the measuring conditions is 2.11±0.10. Example of the measuring column: GPC column manufactured by PL Inc., PLgel 10, mixed type (inside diameter 7.5 m×length 30 cm, two columns coupled) A molecular weight of a binder resin in the toner can be similarly measured.

Glass Transition Temperature: Tg

In a differential thermal analyzer (DTA-40 manufactured by Shimazu Seisakusho), a tangent is drawn at a starting portion of transition (inflexion point) of a curve measured under the condition of a temperature raising rate 10° C./min. and a temperature at the intersection is considered as a glass transition temperature.

Flow Softening Temperature

In a flow tester (CFT-500 manufactured by Shimazu Seisakusho), a sample of 1 g is measured under the conditions such as a nozzle of 1 mm 10 mm, load of 30 kg, preheating time of 5 minutes at 50° C. and temperature raising rate of 3° C./min. and a temperature at an intermediate point of a distance from the start to the end of flow is considered as the softening temperature.

EXAMPLES

The present invention is described in detail, referring to the examples. However, the present invention is not limited to the following examples unless otherwise the examples exceed the subject matter of the present invention. In the example, a wording "part" simply means "part by weight".

Example 1

| | |
|---|---|
| •Styrene/n-butyl acrylate copolymer A | 100 parts by weight |
| •Colorant: Carbon black MA-100 (manufactured by Mitsubishi Kasei Corporation) | 7 parts by weight |
| •Charge control agent: BONTRON P-51 (quaternary ammonium salt) (manufactured by orient Chemical) | 2 parts by weight |
| •Low molecular weight polypropylene: 550P (manufactured by Sanyo Kasei) | 2 parts by weight |

Materials shown above were compounded by a coupled type two-shaft extruder under a condition that the binder resin may be given a step for fully melting, cooled and classified and a black toner with an average particle size of approximately 10 μm was obtained.

Styrene/n-butyl acrylate copolymer A used in this example was obtained through a reaction by bulk polymerization and solution polymerization using xylene as a solvent with a least required use of a polymerization starting agent and without using other accelerators, and 50 parts by weight of a low molecular weight substance based on styrene homopolymerization and 50 parts by weight of a high molecular weight substance based on styrene/n-butyl acrylate copolymerization were mixed while having been dissolved in a xylene solution. In the molecular weight distribution of this resin measured by the GPC, there were a peak of the low molecular weight substance Lp=5,000 and a peak of the high molecular weight substance Hp=100,000 with a shoulder at 1,000,000. A temperature for kneading was set so that the set temperature did not exceed a temperature at which the charge control agent P-51 may be decomposed into amine type substances. Mn of low molecular weight polypropylene 550P is 4,000 and volatile components are 0.4%.

Toner A was obtained by externally adding 0.2 parts by weight of silica particles (R972 manufactured by Nippon Aerosil) to 100 parts by weight of the above black toner in the Henschel mixer. 4 parts by weight of toner A and 100 parts by weight of ferrite particle carrier having an average particle size of 100 μm, which was coated on its surface with a resin containing methyl silicone, were mixed and stirred to obtain the developer A.

Next, an actual copying test for the above-described developer A of 50,000 sheets of paper was conducted under the conditions such as a temperature of 23° to 25° C. and a humidity of 50 to 60% RH by using a copying machine having a copying speed of 50 sheets per min., in which an organic photoconductor was used as a photoreceptor and the fixing device was comprised an upper heat roller which is formed with silicone rubber coated by a thin layer of teflon resin and incorporates a heater lamp, and a lower impression roller formed with silicone rubber, with the fixing temperature set at 190° C. and without supplying a parting agent such as silicone oil. Toner A was used as a supplementary toner in the copying test.

As a result of the copying test, it was clarified that the amount of charge of the developer and the concentration of the toner have been stably maintained from the first sheet to the 50,000th sheet copied. Uniformity of black copied parts was satisfactory without any partial missing of characters, an image density was high and stable, fogging which is staining of white background after copying was not increased, staining due to scattering of the toner in the copying machine was rarely observed, and thus the toner and the developer excelled in durability. In addition, the fixing roller and both sides of paper passed through therebetween was almost free from contamination.

Moreover, the results of evaluation are such that the copying machine has not produced an offensive odor, the quantities of volatile components by the head space method have been little as shown in Table 2, and the offensive odor has not substantially been detected in an organoleptic test at the room temperature and a high temperature. Approximately 77% of the area detected by the head space method has been shared by a monomer and a xylene solvent derived from the binder resin.

Example 2

| | |
|---|---|
| •Styrene/n-butyl acrylate copolymer B | 100 parts |
| •Colorant: carbon black MA-100 | 7 parts |
| •Charge control agent: nigrosine N-04 (manufactured by Orient Chemical) | 3 parts |
| •Low molecular weight polypropylene | 3 parts |

The above substances were compounded and a black toner with an average particle size of approximately 10 μm was obtained by the same method as in the example 1.

Styrene/n-butyl acrylate copolymer B used in this example was obtained through a reaction by bulk polymerization and solution polymerization using xylene as a solvent with a least required use of a polymerization starting agent and without using other accelerators, and 60 parts by weight of a low molecular weight substance based on styrene homopolymerization and 40 parts by weight of a high molecular weight substance based on styrene/n-butyl acrylate copolymerization were mixed while having been dissolved in a xylene solution. In the molecular weight distribution of this resin measured by the GPC, Lp=5,500 and Hp=400,000 were obtained. In this example, the charge control agent nigrosine N-04 which contains less impurities such as amine substances was used. Mn of low molecular weight polypropylene is 8,000 and volatile components are 0.3%.

The toner B was obtained through external addition processing similar to the example 1. 7 parts by weight of the toner B thus obtained and 100 parts by weight of iron particle carrier which was coated on its surface with a fluorine type resin and has the average particle size of 70 μm were mixed and stirred to obtain the developer B.

A copying test of 3,000 sheets was conducted under the conditions such as a temperature of 23° to 25° C. and a humidity of 50 to 60% RH by using a personal copying machine (five A4 size sheets/min.) in which an ,organic photoconductor was used as a photreceptor and a heat roller fixing device comprising a teflon-coated roller and a silicone rubber roller was used. The toner B was used as a supplementary toner for use in the copying test.

As a result of the copying test, it was clarified that the amount of charge of the developer and the concentration of the toner have been stably maintained from the first sheet to the 3,000th sheet copied. Uniformity of black copied parts was satisfactory without any partial missing of characters, an image density was high and stable, fogging which is staining of white background after copying was not increased, staining due to scattering of the toner in the copying machine was rarely observed, and thus the toner and the developer excelled in durability. In addition, the fixing roller and both sides of paper passed through therebetween was almost free from contamination.

Moreover, the copying test showed an excellent result that the copying machine has not produced an offensive odor, the quantities of volatile components by the head space method have been little as shown in Table 2, and the offensive odor has not substantially been detected in an organoleptic test. Approximately 90% of the area detected by the head space method has been shared by a monomer and a solvent derived from the binder resin.

Example 3

A black toner having an average particle size of 10 μm was obtained by a similar method to the example 2 except that a styrene/n-butyl acrylate copolymer C was used instead of a styrene/n-butyl acrylate copolymer B.

Styrene/n-butyl acrylate copolymer C used in this example was obtained through a reaction by bulk polymerization and solution polymerization using xylene as a solvent with a least required use of a polymerization starting agent and without using other accelerators, and 50 parts by weight of a low molecular weight substance based on styrene/n-butyl acrylate copolymerization and 50 parts by weight of a high molecular weight substance based on styrene/n-butyl acrylate copolymerization were mixed while having been dissolved in a xylene solution. In the molecular weight distribution of this resin measured by the GPC, Lp=3,500 and Hp=700,000 were obtained.

A toner C was obtained by processing the above black toner through the same external addition as in the example 1.

A developer C was prepared as in the example 2 except that the toner C was used instead of the toner B, and the copying test was conducted as in the example 2.

As a result of the test, clear images have been maintained from the initial copying up to copying of the 3,000th sheet as in the example 2 and a stain due to fixing was not found. In addition, the copying machine did not produce an offensive odor, the quantities of volatile components according to the head space method were little as shown in Table 2, and the results of the organoleptic test were excellent. Approximately 85% of the detection area by the head space method was derived from the raw material monomer and the solvent for the binder resin.

Example 4

| | |
|---|---|
| •Styrene/n-butyl acrylate copolymer B (same as used in the example 2) | 100 parts |
| •Colorant: Pigment red 112 | 7 parts |
| •Charge control agent: BONTRON P-51 | 2 parts |
| •Low molecular weight polypropylene 550P | 2 parts |

Those substances shown above were compounded and a red toner with an average particle size of approximately 10 μm was obtained by the same method as in the example 1.

A toner D was obtained by processing the above red toner through the same external addition as in the example 1.

A developer D was prepared as in the example 1 except that the toner D was used instead of the toner A, and the copying test was conducted as in the example 2.

As a result of the test, clear images have been maintained from the initial copying up to copying of the 3,000th sheet as in the example 2 and a stain due to fixing was not found. In addition, the copying machine did not produce an offensive odor, the quantities of volatile components according to the head space method were little as shown in Table 2, and the results of the organoleptic test were excellent. Approximately 85% of the detection area by the head space method was derived from the raw material monomer and the solvent for the binder resin.

Comparative Example 1

A black toner having an average particle size of approximately 10 μm was prepared by a similar method to the example 2 except that a styrene/n-butyl acrylate copolymer E was used instead of a styrene/n-butyl acrylate copolymer B.

Styrene/n-butyl acrylate copolymer E used in this example was obtained through a reaction by bulk polymerization and solution polymerization using xylene as a solvent with a least required use of a polymerization starting agent and without using other accelerators, and a low molecular weight substance based on styrene homopolymerization and a high molecular weight substance based on styrene/n-butyl acrylate copolymerization were mixed while having been dissolved in a xylene solution.

A toner E was obtained by processing the above black toner through the same external addition as in the example 1.

A developer E was prepared as in the example 2 except that the toner E was used instead of the toner B, and the copying test was conducted as in the example 2.

As a result of the test, clear images have been maintained from the initial copying up to copying of the 3,000th sheet as in the example 2 and a stain due to fixing was not found. However, a peculiar odor was produced from the copying machine. As shown in Table 2, the quantities of volatile components according to the head space method were large and the results of the organoleptic test appeared at a unsatisfactory level.

Comparative example 2

| | |
|---|---|
| •Styrene/acryl copolymer F | 100 parts |
| •Colorant: Carbon black MA-100 | 5 parts |
| •Charge control agent: BONTRON P-51 | 2 parts |
| •Low molecular weight polypropylene (same as in the example 2) | 2 parts |

Those substances shown above were compounded and a black toner with an average particle size of approximately 10 μm was obtained by kneading, pulverizing and classifying by a coupled type two-shaft extruder.

Styrene/n-butyl acrylate copolymer F used in this example was obtained through a reaction by bulk polymerization and solution polymerization using xylene as a solvent with a least required use of a polymerization starting agent and without using other accelerators, and 75 parts by weight of a low molecular weight substance based on styrene/n-butyl acrylate copolymerization and 25 parts by weight of a high molecular weight substance based on styrene/n-butyl acrylate copolymerization were mixed while having been dissolved in a xylene solution. In the molecular weight distribution of this resin measured by the GPC, Lp=8,000 and Hp=800,000 were obtained.

A toner F was obtained by processing the above black toner through the same external addition as in the example 1.

A developer F was prepared as in the example 1 except that the toner F was used instead of the toner A, and the copying test was conducted as in the example 1.

As a result of the test, clear images have been maintained from the initial copying up to copying of the 50,000th sheet as in the example 2 and a stain due to fixing was not found. However, a peculiar odor was produced from the copying machine. As shown in Table 2, the results of the organoleptic test appeared at a unsatisfactory level.

Comparative Example 3

| | |
|---|---|
| •Styrene/acryl copolymer G | 100 parts |
| Colorant: Carbon black MA-100 | 7 parts |
| •Charge control agent: BONTRON P-51 | 2 parts |
| •Low molecular weight polypropylene 550P | 2 parts |

Those substances shown above were compounded and a black toner with an average particle size of approximately 10 μm was obtained by kneading, pulverizing and classifying by a coupled type two-shaft extruder.

Styrene/n-butyl acrylate copolymer G used in this example was obtained through a reaction by bulk polymerization and solution polymerization using xylene as a solvent with a normal use of a polymerization starting agent and other accelerators, and 60 parts by weight of a low molecular weight substance based on styrene/n-butyl acrylate copolymerization and 40 parts by weight of a high molecular weight substance based on styrene/n-butyl acrylate copolymerization were mixed while having been dissolved in a xylene solution. In the molecular weight distribution of this resin measured by the GPC, Lp=5,500 and Hp=800,000 were obtained.

A toner G was obtained by processing the above black toner through the same external addition as in the example 1.

A developer G was prepared as in the example 1 except that the toner G was used instead of the toner A, and the copying test was conducted as in the example 1.

A stain by the fixing roller due to a hot offset phenomenon occurred even in the initial stage of the copying test. Moreover, the image density gradually fell from the 10,000th sheet and further fell to an unallowable level at the 25,000th sheet. A peculiar odor was produced from the copying machine. Both the result of evaluation by the head space method and the result of the organoleptic test of the odor appeared at unsatisfactory levels as shown in Table 2. Approximately 50% of the detection area by the head space method was shared by the raw material monomer of the binder resin and the solvent and a number of peaks were otherwise observed. In other words, it was clarified that many kinds of volatile impurities are contained.

Organoleptic Inspection

An odor of the toners A to G prepared as described above was evaluated by the organoleptic inspection by inspectors. This inspection included normal temperature evaluation for evaluating an odor of the toner immediately after the closed container in which the toner is sealed has been kept as is for several days, and high temperature evaluation for evaluating the odor after placing an open glass vial containing the toner on a hot plate of approximately 135° C. With the name of the test sample kept unrevealed, the inspection was conducted by a plurality of inspectors for a plurality of days and the evaluation points of the inspectors were averaged and ranked in the order from the lowest point.

Table 2 summarizes the results of the organoleptic inspections and the measured valued by the head space method. As known from these results, the head space method is well correlated to the organoleptic inspection.

TABLE 1

| | Resins used in Examples and Comparative Examples | | | | | | | | | |
|---|---|---|---|---|---|---|---|---|---|---|
| | Weight ratio of monomer | | | | Peak of molecular weight | | Weight ratio | | | |
| | Low molecular weight substance | | High molecular weight substance | | Low molecular weight substance | High molecular weight substance | Low molecular weight substance | High molecular weight substance | Resin Tf (°C.) | Resin Tg (°C.) |
| | Styrene | n-butylacrylate | Styrene | n-butylacrylate | | | | | | |
| Example 1 | 100 | 0 | 75 | 25 | 5,000 | 100,000 | 50 | 50 | 125 | 58 |
| Example 2 | 100 | 0 | 75 | 25 | 5,500 | 400,000 | 60 | 40 | 130 | 60 |
| Example 3 | 95 | 5 | 75 | 25 | 3,500 | 700,000 | 50 | 50 | 124 | 57 |
| Example 4 | (Same as embodiment 2) | | | | | | | | | |
| Comparative example 1 | 100 | 0 | 75 | 25 | 7,000 | 400,000 | 60 | 40 | 128 | 60 |
| Comparative example 2 | 88 | 12 | 75 | 25 | 8,000 | 800,000 | 75 | 25 | 134 | 61 |
| Comparative example 3 | 88 | 12 | 75 | 25 | 5,500 | 80,000 | 60 | 40 | 122 | 56 |

TABLE 2

| | Quantity of volatile component (ppm) | Monomer & solvent components (%) | Organoleptic test Normal temp. | Organoleptic test High temp. | Odor from copying machine | Actual copying characteristic | Fixing characteristic |
|---|---|---|---|---|---|---|---|
| Example 1 | 600 | 77 | 1 | 3 | ○ | ○ | ○ |
| Example 2 | 610 | 90 | 2 | 1 | ○ | ○ | ○ |
| Example 3 | 720 | 85 | 4 | 2 | ○ | ○ | ○ |
| Example 4 | 640 | 85 | 3 | 4 | ○ | ○ | ○ |
| Comparative example 1 | 1100 | 90 | 6 | 6 | X | ○ | ○ |
| Comparative example 2 | 870 | 73 | 5 | 5 | X | ○ | ○ |
| Comparative example 3 | 1800 | 50 | 7 | 7 | X | X | |

○-acceptable
X-unacceptable
XX-very bad.

What is claimed is:

1. A toner for heat fixing having reduced offensive odor comprising a styrene-based binder resin and a colorant wherein the toner has a quantity, A, of volatile components as measured by the head space method and wherein a percentage, B, of said quantity of volatile components, A, is attributed to raw material monomers and solvents used in production of said styrene-based binder resin and wherein A and B satisfy one or both of the following formulae:

$A \leqq 900$ ppm and $B \geqq 80\%$, or $A \leqq 650$ ppm and $B \geqq 70\%$.

2. A toner for heat fixing according to claim 1, wherein said styrene-based binder resin has at least one molecular weight peak of a low molecular weight substance in the range of 3,000 to 80,000 and at least one molecular weight peak of a high molecular weight substance in the range of 80,000 to 1,500,000.

3. A toner for heat fixing according to claim 2, wherein a weight ratio of the low molecular weight substance to the high molecular weight substance is from 80:20 to 40:60.

4. A toner for heat fixing according to claim 2, wherein said low molecular weight substance is a styrene-based polymer comprising 50 to 100 parts by weight of styrene and 50 to 0 parts by weight of ester acrylate, ester methacrylate, or a mixture thereof, in terms of monomer.

5. A toner for heat fixing according to claim 2, wherein said high molecular weight substance is a styrene-based polymer comprising 40 to 90 parts by weight of styrene and 60 to 10 parts by weight of ester acrylate, ester methacrylate, or a mixture thereof in terms of monomer.

6. A toner for heat fixing according to claim 1, wherein said styrene-based binder resin has a glass transition temperature of 50° C. or over.

7. A toner for heat fixing according to claim 1, wherein said styrene-based binder resin has a flow softening temperature of from 80° to 160° C.

8. A toner for heat fixing according to claim 1, wherein said styrene-based binder resin is 70 weight % or over of the total quantity of resin in the toner.

9. A toner for heat fixing according to claim 1, wherein said styrene-based binder resin is selected from the group consisting of polystyrene, a styrene-ester acrylate copolymer, a styrene-ester methacrylate copolymer, and a styrene-butadiene copolymer.

10. A toner for heat fixing according to claim 1, wherein said toner further comprises a polyolefin wax.

11. A toner for heat fixing according to claim 10, wherein said polyolefin wax has a number-average molecular weight of from 3,000 to 10,000.

12. A toner for heat fixing according to claim 10, wherein said polyolefin wax is present in an amount of from 0.2 to 10 parts by weight in reference to 100 parts by weight of the styrene-based binder resin.

13. A toner for heat fixing according to claim 10, wherein said polyolefin wax has a volatile components content of 0.5% or less.

* * * * *